US008961108B2

(12) United States Patent
Bergman et al.

(10) Patent No.: US 8,961,108 B2
(45) Date of Patent: Feb. 24, 2015

(54) COOLING SYSTEM FOR A TURBINE VANE

(75) Inventors: Russell J. Bergman, Windsor, CT (US); Shawn J. Gregg, Wethersfield, CT (US); Michael Papple, Verdun (CA); Paul M. Lutjen, Kennebunkport, ME (US); Joseph T. Caprario, Cromwell, CT (US); Mohammed Ennacer, St-Hubert (CA); Thurman Carlo Dabbs, Dover, NH (US)

(73) Assignee: United Technologies Corporation, Hartford, CT (US)

( * ) Notice: Subject to any disclaimer, the term of this patent is extended or adjusted under 35 U.S.C. 154(b) by 540 days.

(21) Appl. No.: 13/439,277

(22) Filed: Apr. 4, 2012

(65) Prior Publication Data

US 2013/0266416 A1 Oct. 10, 2013

(51) Int. Cl.
*F01D 9/06* (2006.01)

(52) U.S. Cl.
USPC ..... 415/115

(58) Field of Classification Search
None
See application file for complete search history.

(56) References Cited

U.S. PATENT DOCUMENTS

| | | | | |
|---|---|---|---|---|
| 5,498,126 | A * | 3/1996 | Pighetti et al. | 415/115 |
| 6,254,333 | B1 | 7/2001 | Merry | |
| 6,984,101 | B2 | 1/2006 | Schiavo, Jr. | |
| 7,004,721 | B2 * | 2/2006 | Imbourg et al. | 415/115 |
| 7,946,801 | B2 | 5/2011 | Shapiro et al. | |
| 2005/0281663 | A1 | 12/2005 | Trindade et al. | |
| 2008/0190114 | A1 | 8/2008 | Surace et al. | |
| 2011/0044801 | A1 | 2/2011 | Di Paola et al. | |
| 2011/0085894 | A1 | 4/2011 | Dueckershoff et al. | |
| 2012/0134781 | A1 * | 5/2012 | Khanin et al. | 415/115 |

FOREIGN PATENT DOCUMENTS

GB 2454014 A 4/2009

OTHER PUBLICATIONS

International Search Report and Written Opionion, mailed Mar. 25, 2013.

* cited by examiner

*Primary Examiner* — Richard Edgar
(74) *Attorney, Agent, or Firm* — Kinney & Lange, P.A.

(57) ABSTRACT

A cooling system for a gas turbine engine includes a first plenum, a first cooling flow passageway, and a second cooling flow passageway. The first cooling flow passageway is in fluid communication with the first plenum and with a first airfoil cooling channel within an airfoil of the stator vane. The first airfoil cooling channel is for cooling a leading edge of the airfoil. The second cooling flow passageway is in fluid communication with the first plenum and with a platform cooling channel within an outer diameter platform of the stator vane. The first cooling flow passageway and the second cooling flow passageway are disposed within a mounting hook. The first cooling flow passageway and the second cooling flow passageway are not in fluid communication with each other.

23 Claims, 14 Drawing Sheets

COOLING SYSTEM FOR A TURBINE VANE

BACKGROUND

The present invention relates to a turbine engine. In particular, the invention relates cooling turbine vanes in a gas turbine engine.

A turbine engine ignites compressed air and fuel to create a flow of hot combustion gases to drive multiple stages of turbine blades. The turbine blades extract energy from the flow of hot combustion gases to drive a rotor. The turbine rotor drives a fan to provide thrust and drives compressor to provide a flow of compressed air. Vanes interspersed between the multiple stages of turbine blades align the flow of hot combustion gases for an efficient attack angle on the turbine blades.

Turbine vanes exposed to such high-temperature combustion gases must be cooled to extend their useful lives. Cooling air is typically taken from the flow of compressed air. Therefore, some of the energy extracted from the flow of combustion gases must be expended to provide the compressed air used to cool the turbine vanes. Energy expended on compressing air used for cooling turbine vanes is not available to produce thrust. Improvements in the efficient use of compressed air for cooling turbine vanes can improve the overall efficiency of the turbine engine.

SUMMARY

An embodiment of the present invention is a cooling system for a gas turbine engine. The cooling system includes a first plenum, a first cooling flow passageway, and a second cooling flow passageway. The first plenum is bounded in part by a first portion of an engine casing and a mounting hook. The first portion of the engine casing is disposed radially outward from a rotor stage adjacent to a stator vane. The mounting hook connects the stator vane to the engine casing between the first portion of the engine casing and a second portion of the engine casing disposed radially outward from the stator vane. The first cooling flow passageway is in fluid communication with the first plenum and with a first airfoil cooling channel within an airfoil of the stator vane. The first airfoil cooling channel is for cooling a leading edge of the airfoil. The second cooling flow passageway is in fluid communication with the first plenum and with a platform cooling channel within an outer diameter platform of the stator vane. The first cooling flow passageway and the second cooling flow passageway are disposed within the mounting hook. The first cooling flow passageway and the second cooling flow passageway are not in fluid communication with each other.

DETAILED DESCRIPTION

The present invention provides multiple cooling feeds to portions of a stator vane to efficiently supply their different cooling requirements. Cooling air is supplied by three separate cooling flow passageways within a stator vane to cool a vane airfoil leading edge, a vane airfoil trailing edge, and a vane outside diameter platform. Two cooling flow passageways supply cooling air through a mounting hook connected to the platform. A first cooling flow passageway supplies high-pressure cooling air through the mounting hook to a cooling channel within the vane airfoil near the leading edge. A second cooling flow passageway supplies high-pressure cooling air from a cooling channel in an adjacent component, such as a blade outer air seal (BOAS), to the vane outside diameter platform. A third cooling flow passageway supplies intermediate-pressure cooling air through the platform to a cooling channel within the vane airfoil near the trailing edge. Supplying cooling air by three separate passageways allows a turbine engine to expend less energy in providing cooling air to a stator vane by supplying lower-pressure cooling air where higher-pressure cooling air is not required and reusing cooling air that was previously used to cool another engine component.

Figure 1:
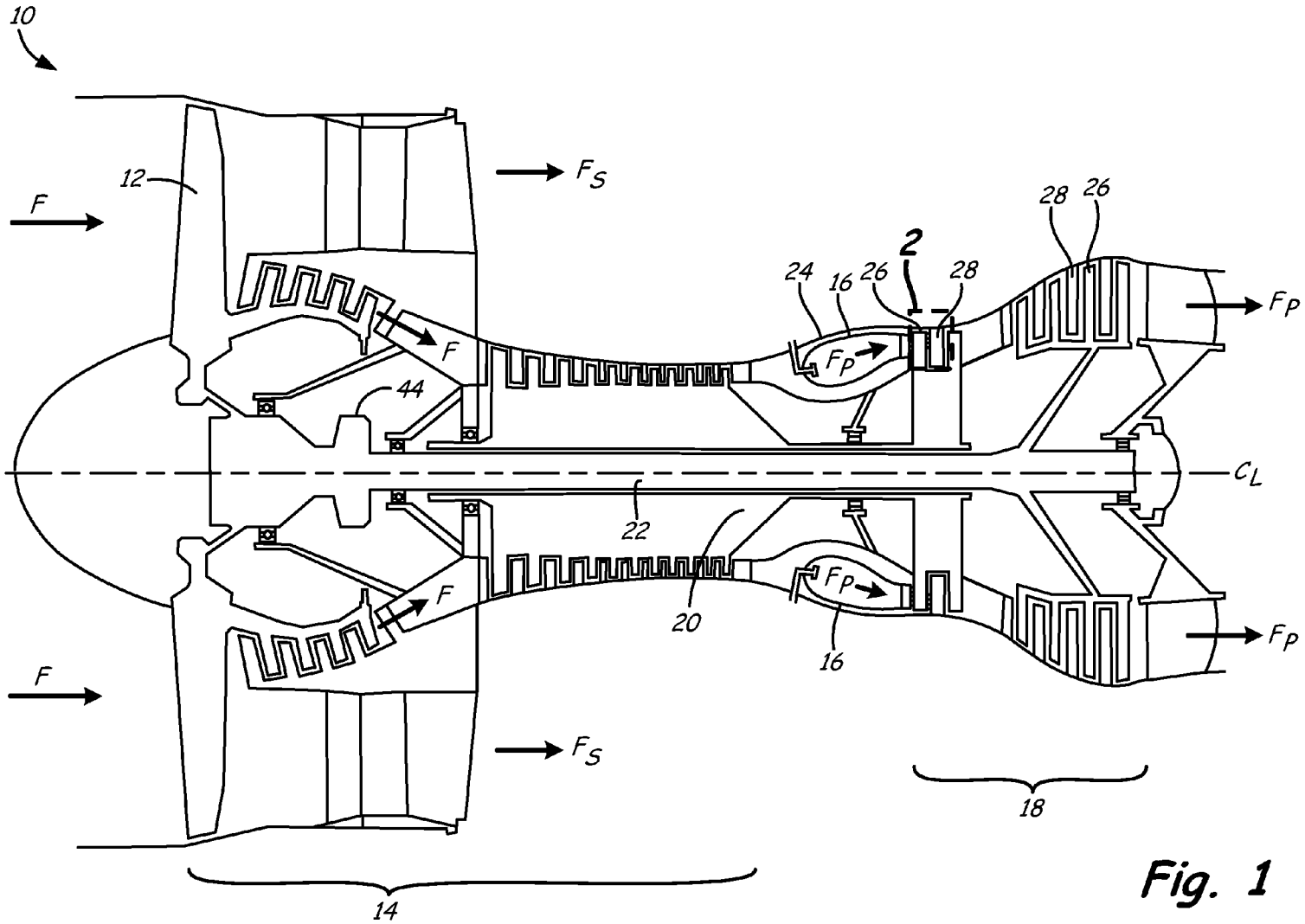
FIG. 1 is a sectional view of a gas turbine engine embodying a multi-feed cooling system.

FIG. 1 is a representative illustration of a gas turbine engine including a cooling system and stator vanes embodying the present invention. The view in FIG. 1 is a longitudinal sectional view along an engine center line. FIG. 1 shows gas turbine engine 10 including fan 12, compressor 14, combustor 16, turbine 18, high-pressure rotor 20, low-pressure rotor 22, and engine casing 24. Turbine 18 includes rotor stages 26 and stator stages 28.

As illustrated in FIG. 1, fan 12 is positioned along engine center line ($C_L$) at one end of gas turbine engine 10. Compressor 14 is adjacent fan 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan 12. Rotor stages 26 and stator stages 28 are arranged throughout turbine 18 in alternating rows. Rotor stages 26 connect to high-pressure rotor 20 and low-pressure rotor 22. Engine casing 24 surrounds turbine engine 10 providing structural support for compressor 14, combustor 16, and turbine 18, as well as containment for cooling air flows, as described below.

In operation, air flow F enters compressor 14 through fan 12. Air flow F is compressed by the rotation of compressor 14 driven by high-pressure rotor 20. The compressed air from compressor 14 is divided, with a portion going to combustor 16, and a portion employed for cooling components exposed to high-temperature combustion gases, such as stator vanes, as described below. Compressed air and fuel are mixed and ignited in combustor 16 to produce high-temperature, high-pressure combustion gases Fp. Combustion gases Fp exit combustor 16 into turbine section 18. Stator stages 28 properly align the flow of combustion gases Fp for an efficient attack angle on subsequent rotor stages 26. The flow of combustion gases Fp past rotor stages 26 drives rotation of both high-pressure rotor 20 and low-pressure rotor 22. High-pressure rotor 20 drives a high-pressure portion of compressor 14, as noted above, and low-pressure rotor 22 drives fan 12 to produce thrust Fs from gas turbine engine 10. Although embodiments of the present invention are illustrated for a turbofan gas turbine engine for aviation use, it is understood that the present invention applies to other aviation gas turbine engines and to industrial gas turbine engines as well.

Figure 2:
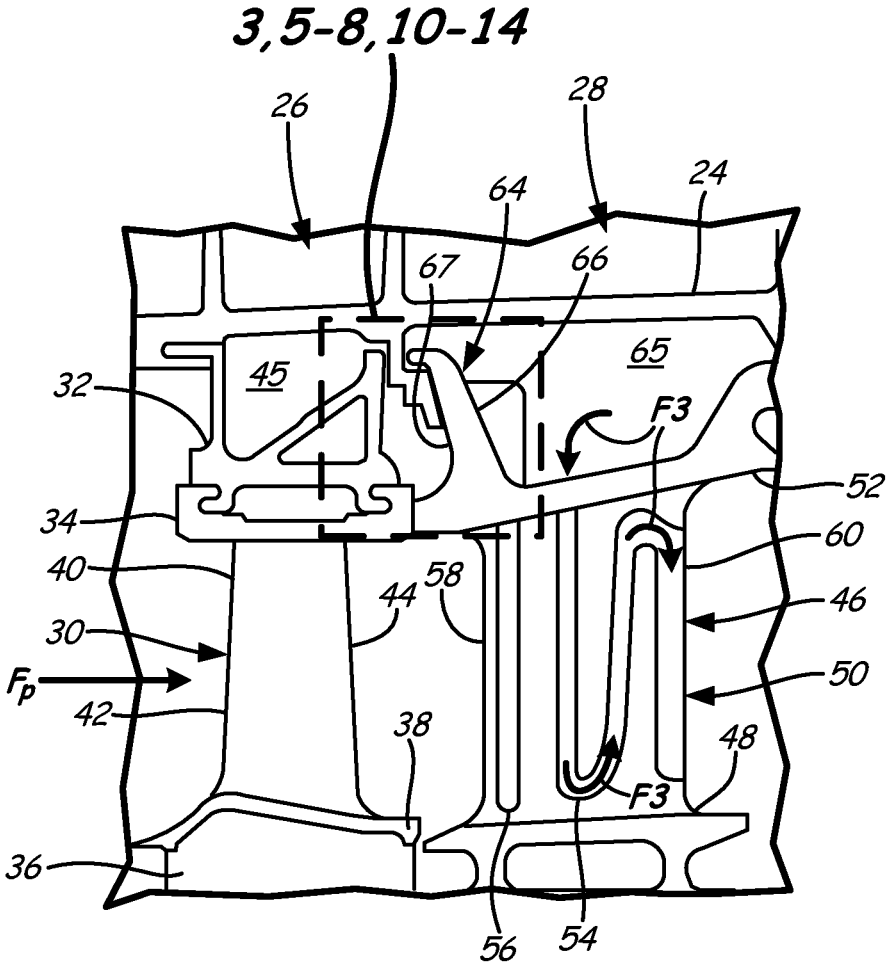
FIG. 2 is an enlarged view of a turbine portion of the gas turbine engine shown in FIG. 1 with a turbine vane airfoil cutaway to show internal cooling channels.

FIG. 2 is an enlarged view of a turbine portion of the gas turbine engine shown in FIG. 1 with a turbine vane airfoil cutaway to show internal cooling channels. FIG. 2 illustrates rotor stage 26, stator stage 28, first plenum 45, and second plenum 65. Rotor stage 26 includes rotor blade 30, blade outer air seal (BOAS) support 32, and BOAS 34. Rotor blade 30 includes blade root 36, blade platform 38, and blade airfoil 40. Blade platform 38 is predominantly arcuate in shape in a circumferential direction with a center of the arc coincident with engine center line $C_L$. Blade airfoil 40 has a leading edge 42 and a trailing edge 44. Rotor stage 26 connects to high-pressure rotor 20 by blade root 36. Platform 38 connects blade airfoil 40 to blade root 36 such that leading edge 42 faces the upstream flow of combustion gases Fp and trailing edge 44 faces the downstream flow of combustion gases Fp. BOAS 34 is positioned radially outward from rotor blade 30, with respect to engine center line $C_L$ as shown in FIG. 1. BOAS 34 is held in position by BOAS support 32, which is connected to engine casing 24. First plenum 45 is a cooling air source radially outward from rotor stage 26 and bounded in part by engine casing 24. Cooling air is supplied to first plenum 45 from a high-pressure stage of compressor 14.

Stator stage 28 includes stator vane 46, vane inside diameter (ID) platform 48, vane airfoil 50, and vane outside diameter (OD) platform 52. Like blade platform 38, vane ID platform 48 and vane OD platform 52 are predominantly arcuate in shape in a circumferential direction with a center of the arc coincident with engine center line $C_L$. As shown in the cutaway view of vane airfoil 50, vane airfoil 50 includes trailing edge internal cooling channel 54, and leading edge internal cooling channel 56. Vane airfoil 50 also has a leading edge 58 and a trailing edge 60. Vane OD platform 52 includes vane mounting hook 64. Vane mounting hook 64 includes vane mounting hook first side 66 and vane mounting hook second side 67. Vane mounting hook first side 66 faces a space radially outward from vane OD platform 52. Vane mounting hook second side 67 faces a direction opposite that of vane mounting hook first side 66. Stator stage 28 connects to engine casing 24 by vane mounting hook 64 of vane OD platform 52. Vane airfoil 50 connects at a radially outer end to vane OD platform 52 and at a radially inner end to vane ID platform 48. Second plenum 65 is a cooling air source radially outward from stator stage 28 and bounded in part by engine casing 24. Cooling air is supplied to second plenum 65 from an intermediate-pressure stage of compressor 14. Thus, cooling air supplied by first plenum 45 is at a pressure higher than the cooling air supplied by second plenum 65. As shown in FIG. 2, second plenum 65 is also bounded by vane mounting hook 64, which separates first plenum 45 from second plenum 65 to maintain the pressure difference between them. Second plenum 65 is in fluid communication with trailing edge internal cooling channel 54 by way of third cooling flow passageway 96 through vane OD platform 52, as described below in reference to FIG. 4.

In operation, as the flow of combustion gases Fp passes through turbine section 18, it enters rotor stage 26 and is channeled between blade platform 38 and BOAS 34. Within rotor stage 26, the flow of combustion gases Fp impinges upon blade airfoil 40 causing rotor blade 30 to rotate about engine center line $C_L$. BOAS 34 is mounted just radially outward from rotor blade 30 and also provides a seal against combustion gases Fp radially bypassing blade airfoil 40. The flow of combustion gases Fp exits rotor stage 26 and enters stator stage 28, where it is channeled between vane ID platform 48 and vane OD platform 52. Within stator stage 28, the flow of combustion gases impinges upon vane airfoil 50 and is thus aligned for a subsequent rotor stage (not shown).

In this embodiment of the present invention, cooling air flows from first plenum 45 and second plenum 65 are directed to some elements of rotor stage 26 and stator stage 28 in direct contact with the flow of combustion gases Fp, such as BOAS 34, vane airfoil 50, and vane OD platform 52. Third cooling air flow F3 flows from second plenum 65 through trailing edge internal cooling channel 54 by way of third cooling flow passageway 96 (shown in FIG. 4) to cool a portion of vane airfoil 50. The portion of vane airfoil cooled by third cooling air flow F3 includes vane trailing edge 60, exiting through film cooling holes (not shown) on the surface of vane airfoil 50, and slots (not shown) at vane trailing edge 60.

Figure 3:
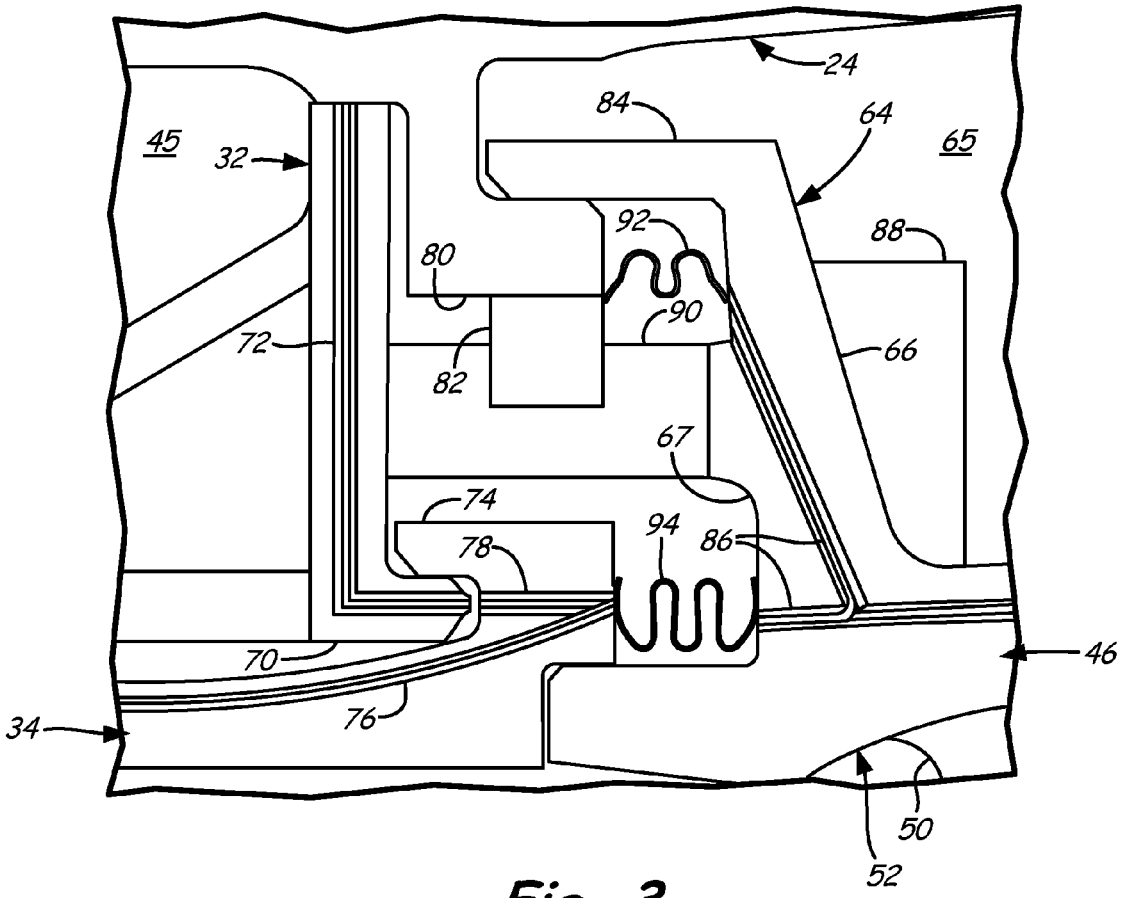
FIG. 3 is a further enlarged side view of a portion of the turbine portion of FIG. 2 illustrating details of a cooling system and stator vane embodying the present invention of a multi-feed cooling system.

FIG. 3 is a further enlarged side view of a portion of FIG. 2 illustrating details of a cooling system and stator vane embodying the present invention of a multi-feed cooling system. In the embodiment illustrated in FIG. 3, BOAS support 32, BOAS 34, and stator vane 46 are each made of individual segments joined together to form annular structures centered on engine centerline $C_L$. FIG. 3 is a side view at a segment end of BOAS support 32, BOAS 34, and stator vane 46. BOAS support 32 includes BOAS support mounting hook 70 and BOAS support feather seal 72. Feather seals, such as BOAS support feather seal 72, are strips of a durable material, such as a metal, inserted into slots at edges of individual segments to seal gaps between segments, yet still allow for some movement between the segments due to thermal effects. Similarly, BOAS 34 includes BOAS mounting hook 74, BOAS main feather seal 76, and BOAS mounting hook feather seal 78. Vane OD platform 52 further includes vane feather seals 86. Vane mounting hook 64 further includes vane mounting flange 84, thicker portion 88 of vane mounting hook 64, and vane alignment feature 90. Engine casing 24 includes casing mounting hook 80 and vane alignment lug 82. Casing mounting hook 80 extends from engine casing 24 with alignment lug 82 positioned periodically at an end of casing mounting hook 80. Vane mounting flange 84 extends from vane mounting hook second side 67 at a point of vane mounting hook farthest from vane airfoil 50. Thicker portion 88 of vane mounting hook 64 begins at an end of vane mounting hook 64 nearest vane airfoil 50. Vane alignment feature 90 extends from vane mounting hook second side 67.

Stator vane 46 attaches to engine casing 24 by the connection of vane mounting flange 84 to casing mounting hook 80 such that vane alignment feature 90 extends through alignment lug 82. The interaction between vane alignment feature 90 and vane alignment lug 82 serves to prevent shifting of a particular segment of stator vane 46 in a circumferential direction. BOAS support 32 also attaches to engine casing 24 by a hook arrangement (not shown). BOAS 34 attaches to BOAS support 32 by the connection of BOAS mounting hook 74 to BOAS support mounting hook 70.

As noted above, in operation, first plenum 45 and second plenum 65 are maintained at different pressures. As shown in FIG. 3, this embodiment of the multi-feed cooling system includes upper seal 92 and lower seal 94. Upper seal 92 is radially outward from vane alignment feature 90 and lower seal 94 is radially inward from vane alignment feature 90. Upper seal 92 and lower seal 94 as shown in FIG. 3 are annular type seals which may be formed sheet-stock based seals ("W" seals), but may also be, for example, C seals, crush seals, dog bone seals, brush seals, or rope seals. Vane mounting hook 64 prevents fluid communication between first plenum 45 and second plenum 65, in combination with upper seal 92, lower seal 94, and vane feather seals 86.

Figure 4:
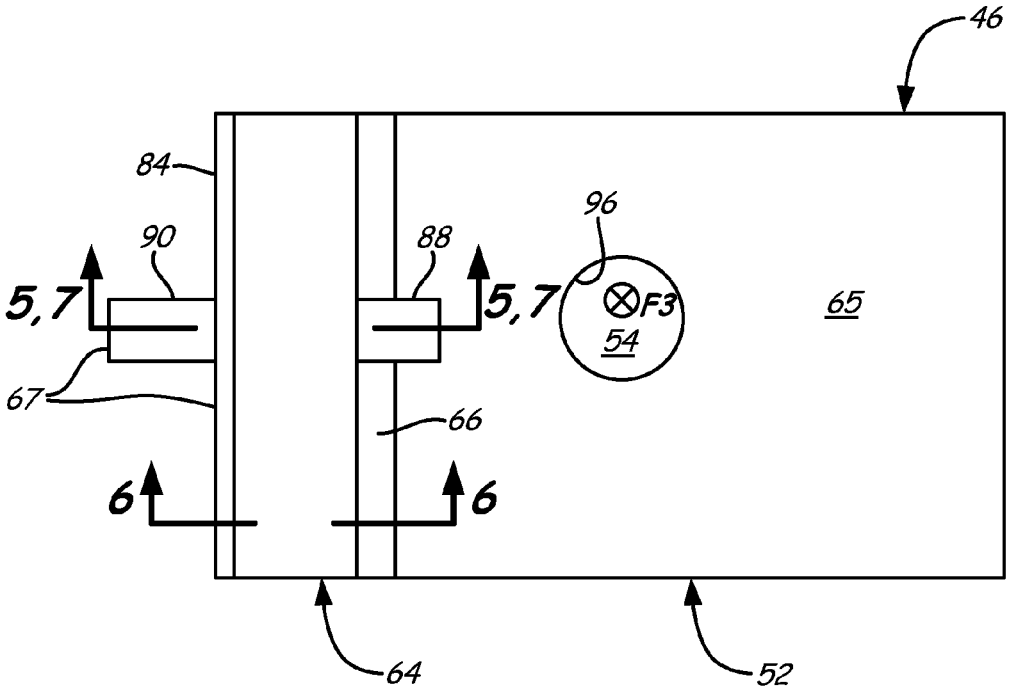
FIG. 4 is a top view of a stator vane illustrating additional details of the embodiment of the multi-feed cooling system shown in FIG. 3.

FIG. 4 is a top view of stator vane 46 illustrating additional details of the embodiment of the multi-feed cooling system shown in FIG. 3. FIG. 4 shows one of the multi-feed cooling passageways, third cooling flow passageway 96 which connects trailing edge internal cooling channel 54 to second plenum 65 such that second plenum 65 is in fluid communication with trailing edge internal cooling channel 54 to provide third cooling air flow F3. FIG. 4 also shows that, in the embodiment of FIG. 3, thicker portion 88 of vane mounting hook 64 and vane alignment feature 90 are aligned with each other.

Figure 5:
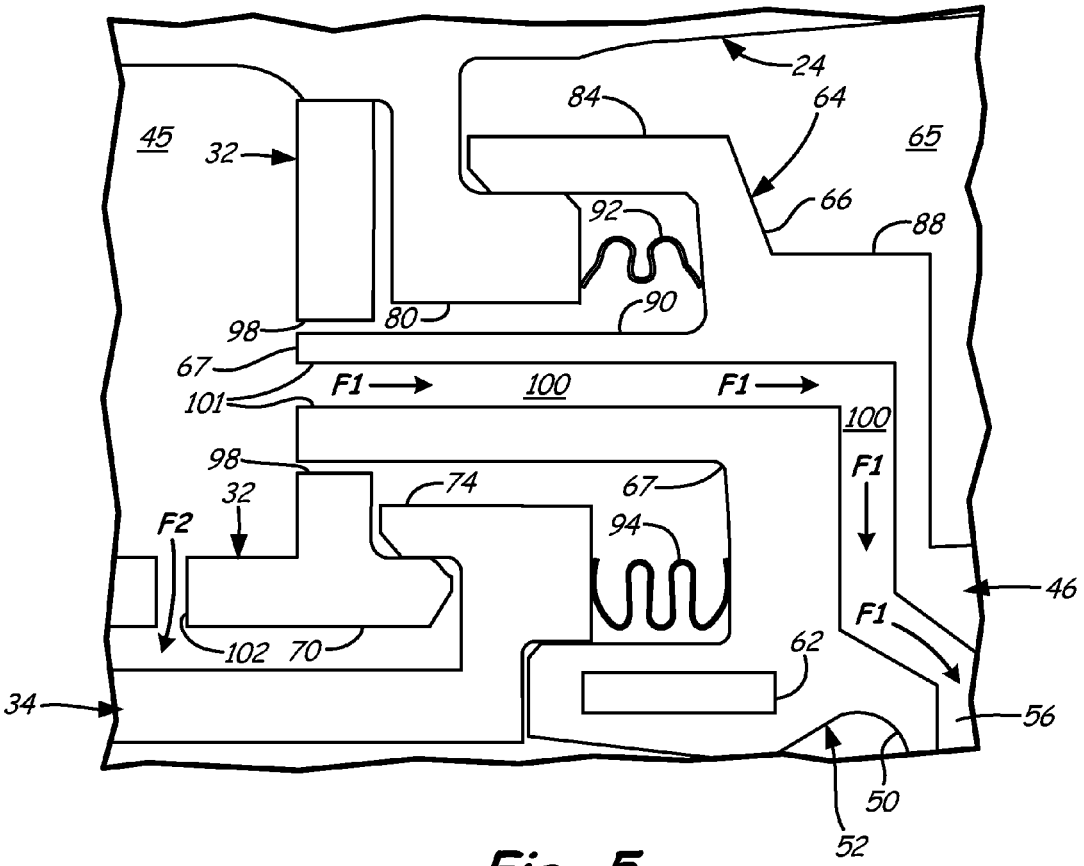
FIG. 5 is a sectional view of the embodiment of the multi-feed cooling system shown in FIG. 3.

FIG. 5 is a sectional view of the embodiment of the multi-feed cooling system shown in FIG. 3 taken along a plane through thicker portion 88 and vane alignment feature 90, as shown in FIG. 4. FIG. 5 shows another one of the multi-feed cooling passageways, first cooling flow passageway 100 connecting leading edge internal cooling channel 56 to first plenum 45. FIG. 5 shows that BOAS support 32 further includes first BOAS support opening 98 and second BOAS support opening 102. Vane mounting hook 64 further includes first cooling flow passageway 100 and first mounting hook opening 101. Vane OD platform 52 further includes vane OD platform cooling channel 62. In this embodiment, first cooling flow passageway 100 extends from first mounting hook opening 101, through vane alignment feature 90 and thicker portion 88 to leading edge internal cooling channel 56. First mounting hook opening 101 is disposed at vane mounting hook second side 67 of alignment feature 90. Alignment feature 90 extends through first BOAS support opening 98. Second BOAS support opening 102 provides second cooling air flow F2 from first plenum 45 to BOAS 34.

In operation, first cooling air flow F1 flows from first plenum 45 into first cooling flow passageway 100 at first mounting hook opening 101. First cooling air flow F1 flows through first cooling flow passageway 100 within vane mounting hook 64 to leading edge internal cooling channel 56. First cooling air flow F1 cools vane leading edge 58 portion of vane airfoil 50 and exits through film cooling holes (not shown) near vane leading edge 58 on the surface of vane airfoil 50. Thicker portion 88 provides additional volume within vane mounting hook 64 to accommodate first cooling flow passageway 100.

Figure 6:
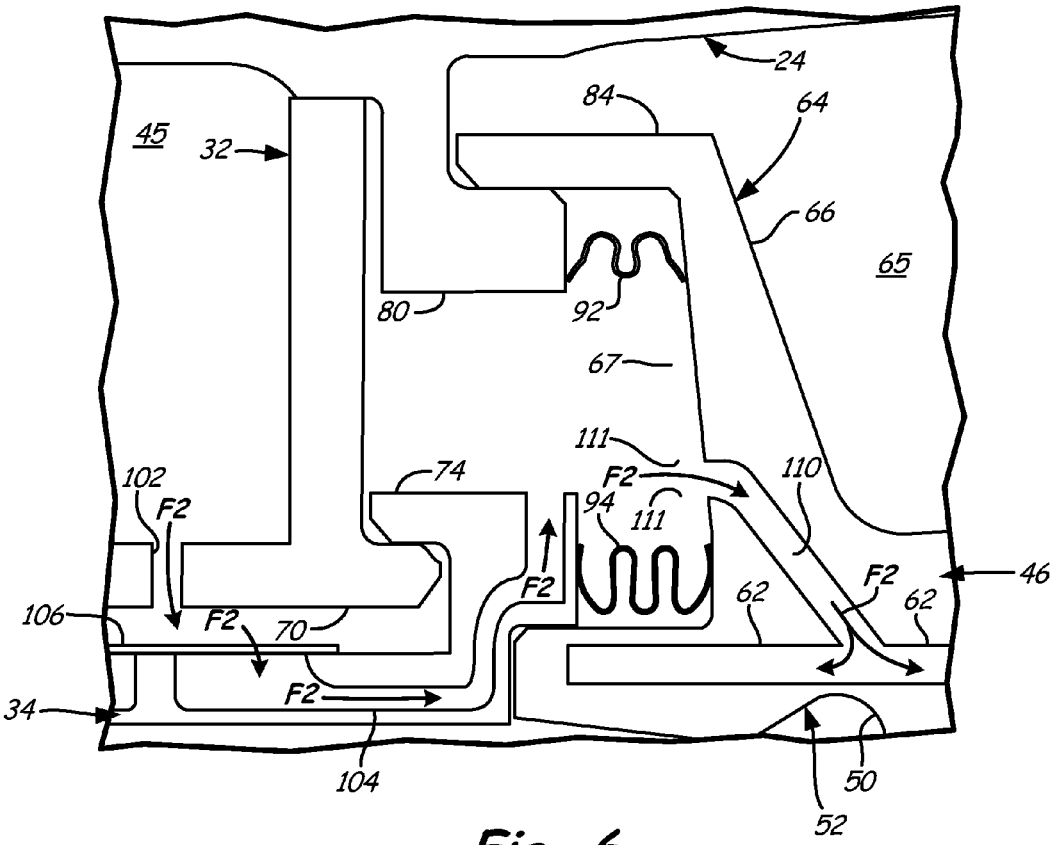
FIG. 6 is another sectional view of the embodiment of the multi-feed cooling system shown in FIG. 3.

FIG. 6 is another sectional view of the embodiment of the multi-feed cooling system shown in FIG. 3 taken along a plane not through thicker portion 88 and vane alignment feature 90, as shown in FIG. 4. FIG. 6 shows yet another one of the multi-feed cooling passageways, second cooling flow passageway 110. FIG. 6 shows that BOAS 34 further includes BOAS cooling channel 104 and BOAS impingement plate 106. BOAS cooling channel 104 is disposed within BOAS 34. BOAS impingement plate 106 is a plate having a plurality of openings. BOAS impingement plate 106 covers cooling air entrances into BOAS cooling channel 104. Vane mounting hook 64 further includes second cooling flow passageway 110 and second mounting hook opening 111. In this embodiment, second cooling flow passageway 110 extends from second mounting hook opening 111, through vane mounting hook 64, to vane OD platform cooling channel 62. Second mounting hook opening 111 is disposed at vane mounting hook second side 67. Second cooling flow passageway 110 connects vane OD platform cooling channel 62 to first plenum 45 by way of second BOAS support opening 102 and BOAS cooling channel 104.

In operation, second cooling air flow F2 flows from first plenum 45, through second BOAS support opening 102, through BOAS impingement plate 106, and into BOAS cooling channel 104. BOAS impingement plate 106 positioned over openings in BOAS cooling channel 104 controls second cooling air flow F2 such that it impinges upon a surface within BOAS cooling channel 104 to absorb heat, and thus cool BOAS 34. Second cooling air flow F2 flows out of BOAS cooling channel 104 into a space between BOAS 34 and vane mounting hook 64. Second cooling air flow F2 then flows into second cooling flow passageway 110 at second mounting hook opening 111. Second cooling air flow F2 flows through second cooling flow passageway 110 within vane mounting hook 64 to vane OD platform cooling channel 62. Second cooling air flow F2 flows through vane OD platform cooling channel 62 to cool vane OD platform 52 and exit through cooling holes (not shown) on the surface of vane OD platform 52.

Separation of first cooling air flow F1 from second cooling air flow F2 is important to maintain the efficient distribution of cooling air to stator vane 46. This separation is achieved within vane mounting hook 64 by virtue of separate passageways—first cooling flow passageway 100 and second cooling flow passageway 110. Separation between first mounting hook opening 101 and second mounting hook opening 111 is achieved in this embodiment by BOAS support 32, BOAS support feather seal 72, BOAS mounting hook feather seal 78, and a close fit between first BOAS support opening 98 and vane alignment feature 90.

Considering FIGS. 2, 3, 4, 5, and 6 together, this embodiment of the present invention provides multiple cooling feeds to portions of stator vane 46 to efficiently supply the cooling needs of stator vane 46. Cooling air is supplied to first plenum 45 from a high-pressure stage of compressor 14 and supplied to second plenum 65 from an intermediate-pressure stage of compressor 14. First plenum 45 and second plenum 65 are maintained at different pressures by vane mounting hook 64 preventing fluid communication between first plenum 45 and second plenum 65. Vane leading edge 58 is upstream from vane trailing edge 60 and exposed to flow of combustion gases Fp at a higher pressure than vane trailing edge 60. Thus, it is more efficient to provide first cooling air flow F1 only to leading edge internal cooling channel 56 from plenum 45 to cool vane leading edge 58, and to provide third flow of cooling air F3 to trailing edge internal cooling channel 54 from second plenum 65 to cool vane trailing edge 60. This separation of cooling flows allows gas turbine engine 10 to expend less energy providing cooling air to stator vane 46. In addition, the embodiment also uses second cooling air flow F2 to cool vane OD platform 52 after it has cooled BOAS 34. Vane OD platform 52 is cooled without taking additional air from either first plenum 45 or second plenum 65, thus further reducing the energy penalty on gas turbine engine 10 to cool stator vane 46.

A method of the present invention for cooling a portion of turbine vane 46 of gas turbine engine 10 includes providing a first source of cooling air to first plenum 45 and providing a source of cooling air to second plenum 65. Next, flowing first cooling air flow F1 from first plenum 45 to leading edge internal cooling channel 56 within vane airfoil 50 to cool vane leading edge 58. First cooling air flow F1 flowing through first cooling flow passageway 100 disposed within vane mounting hook 64 of stator vane 46. Finally, flowing second cooling air flow F2 from first plenum 45 to vane OD platform cooling channel 62 within vane OD platform 52, second cooling air flow F2 flowing through second cooling flow passageway 110, second cooling flow passageway 110 disposed within vane mounting hook 64 of stator vane 46. The method may also include isolating first cooling air flow F1 from second cooling air flow F2. The method may also include flowing second cooling air flow F2 through BOAS cooling channel 104 before flowing second cooling air flow F2 through second cooling flow passageway 110. The method may also include providing a second source of cooling air to second plenum 65 and flowing third cooling air flow F3 from second plenum 65 to trailing edge internal cooling channel 54, third cooling air flow F3 passing through third cooling flow passageway 96.

Figure 7:
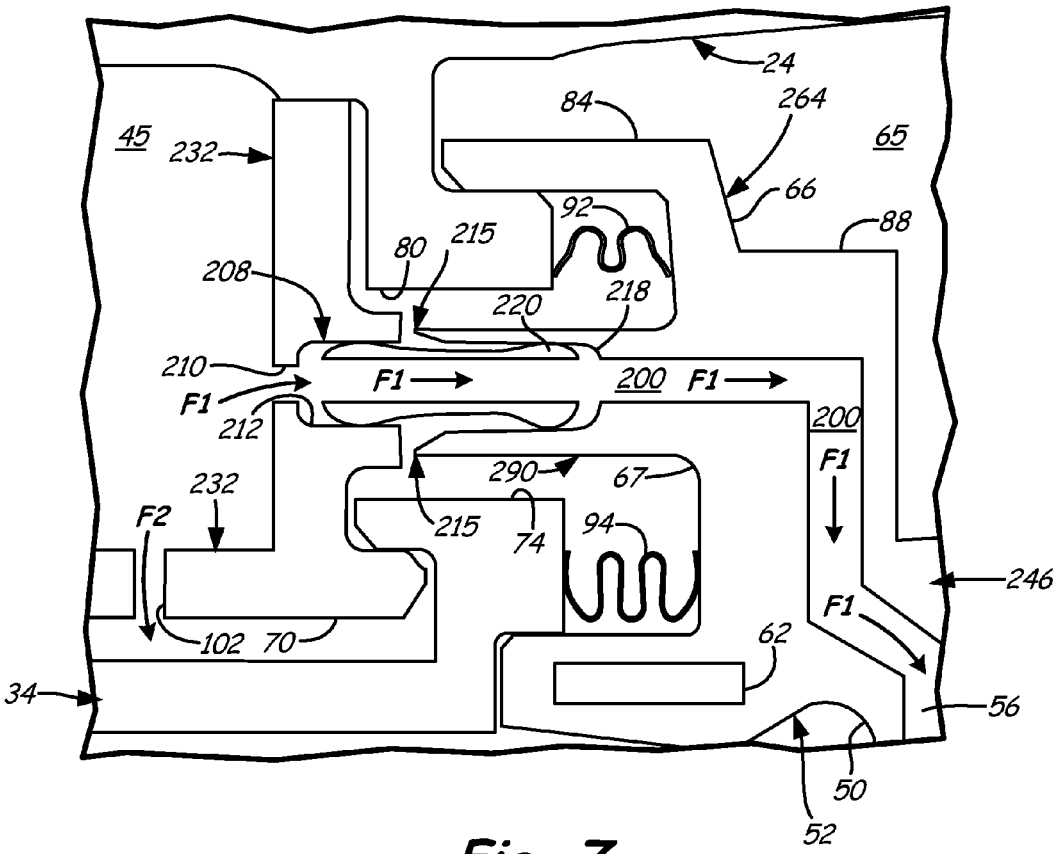
FIG. 7 is a further enlarged sectional view of a portion of the turbine portion of FIG. 2 illustrating details of a cooling system and stator vane embodying the present invention of a multi-feed cooling system.

FIG. 7 is a further enlarged sectional view of a portion of the turbine portion of FIG. 2 illustrating details of a cooling system and stator vane embodying the present invention of a multi-feed cooling system. The embodiment of FIG. 7 is identical to the embodiment of FIG. 3 described above, except for the use of transfer tube 220 between first BOAS support opening 208 and vane alignment feature 290 and changes in BOAS support 232 and stator vane 246 to accommodate use of transfer tube 220. FIG. 7 is a sectional view of the multi-feed cooling system taken along a plane as shown in FIG. 4. FIG. 7 shows first cooling flow passageway 200 connecting leading edge internal cooling channel 56 to first plenum 45. FIG. 7 shows that BOAS support 232 further includes first BOAS support opening 208 instead of first BOAS support opening 98. First BOAS support opening 208 includes narrow portion 210 and wide portion 212. Vane mounting hook 264 of stator vane 246 further includes alignment feature 290. Alignment feature 290 includes first cooling flow passageway 200 and first mounting hook opening 215. First mounting hook opening 215 includes shaped region 218. This embodiment further includes transfer tube 220. Transfer tube 220 is a tubular structure that fits on one end into wide portion 212 of first BOAS support opening 208 and fits on the other end into shape region 218 of first mounting hook opening 215 to provide fluid communication between first BOAS support opening 208 and first cooling flow passageway 200. Narrow portion 210 of first BOAS support opening 208 prevents transfer tube 220 from moving into first plenum 45, and disconnecting from first mounting hook opening 215.

In operation, first cooling air flow F1 flows from first plenum 45, through narrow portion 210 of first BOAS support opening 208, and into first cooling flow passageway 200 at first mounting hook opening 215 by way of transfer tube 220 within wide portion 212 of first BOAS support opening 208 and shaped region 218 of first mounting hook opening 215. First cooling air flow F1 flows through first cooling flow passageway 200 within vane mounting hook 264 to leading edge internal cooling channel 56 to cool vane leading edge 58 portion of vane airfoil 50. In all other aspects, the embodiment of FIG. 7 identical to the embodiment described above in reference to FIGS. 3, 4, 5, and 6.

As with the previous embodiment, the embodiment shown in FIG. 7 provides multiple cooling feeds to portions of stator vane 246 to efficiently supply the cooling needs of stator vane 246. Cooling air supplied by three separate cooling flows to allow gas turbine engine 10 to expend less energy providing cooling air to stator vane 246. The embodiment also uses second cooling air flow F2 to cool vane OD platform 52 after it has cooled BOAS 34, thus cooling vane OD platform 52 without taking additional air from either first plenum 45 or second plenum 65. This further reduces the energy penalty on gas turbine engine 10 to cool stator vane 246.

Figure 8:
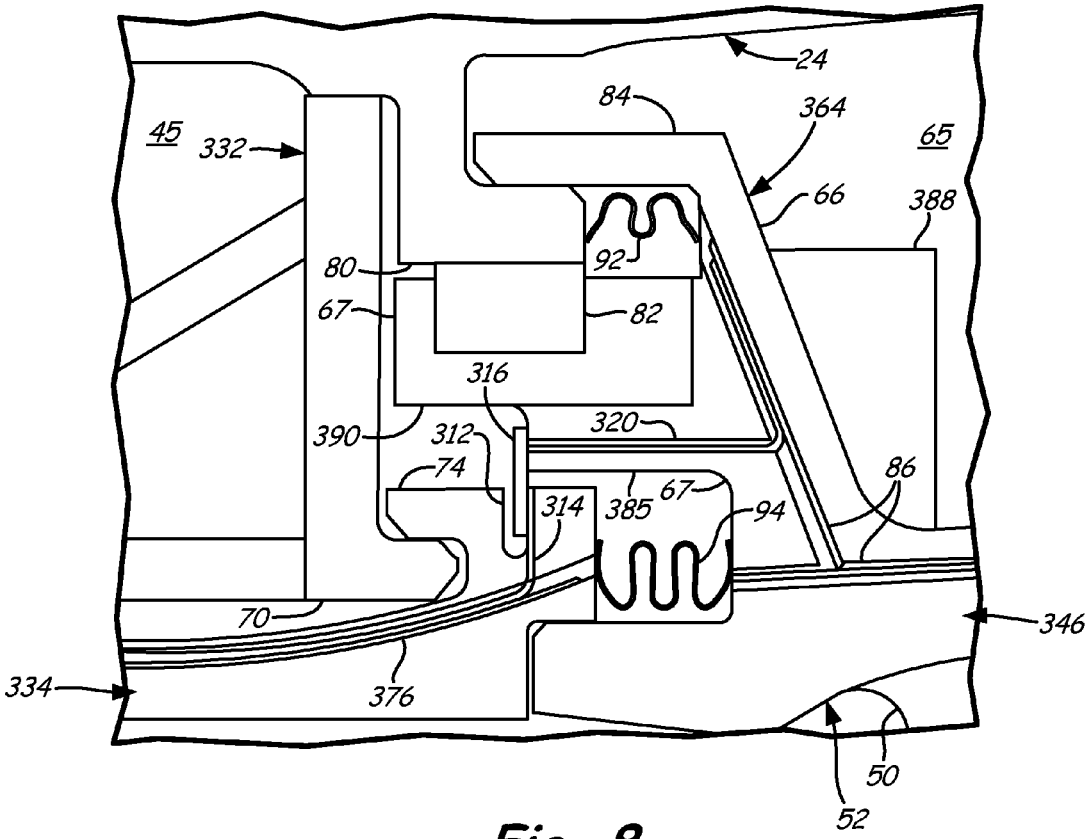
FIG. 8 is a further enlarged side view of a portion of the turbine portion of FIG. 2 illustrating details of a cooling system and stator vane embodying the present invention of a multi-feed cooling system.

FIG. 8 is a further enlarged side view of a portion of the turbine portion of FIG. 2 illustrating details of a cooling system and stator vane embodying the present invention of a multi-feed cooling system. The embodiment of FIG. 8 is identical to the embodiment of FIG. 3 described above, except that, unlike the embodiments described above, first cooling flow passageway 300 is not within vane alignment feature 390 and vane flange 385 and flap seal 316 are employed to help maintain separation between first mounting hook opening 301, shown in FIG. 10, and second mounting hook opening 311, shown in FIG. 11. As shown in FIG. 8 and compared to the embodiment shown in FIG. 3, BOAS support structure 332 does not include BOAS support feather seal 72. BOAS 334 further includes BOAS flap seal channel 312. BOAS vertical feather seal 314 replaces BOAS mounting hook feather seal 78; and BOAS main feather seal 376 is modified as necessary to accommodate a connection with BOAS vertical feather seal 314. Vane mounting hook 364 of stator vane 346 further includes vane flange 385. Vane flange 385 is an annular flange projecting from vane mounting hook second side 67 and includes vane flange feather seal 320. Flap seal 316 is an annular metal band disposed within BOAS flap seal channel 312. Thicker portion 388 of vane mounting hook 364 begins at an end of vane mounting hook 364 nearest vane airfoil 50, as shown in FIG. 8.

Figure 9:
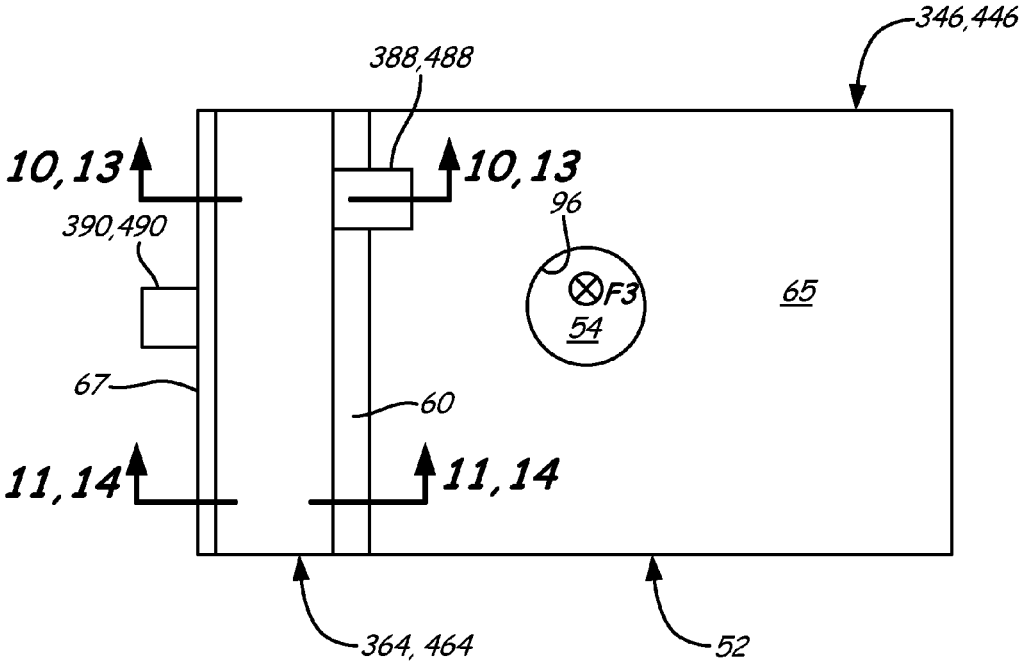
FIG. 9 is a top view of a stator vane illustrating additional details of the embodiment of the multi-feed cooling system shown in FIG. 8.

FIG. 9 is a top view of stator vane 346 illustrating additional details of the embodiment of the multi-feed cooling system shown in FIG. 8. FIG. 9 shows that thicker portion 388 is not in the same plane as vane alignment 390.

Figure 10:
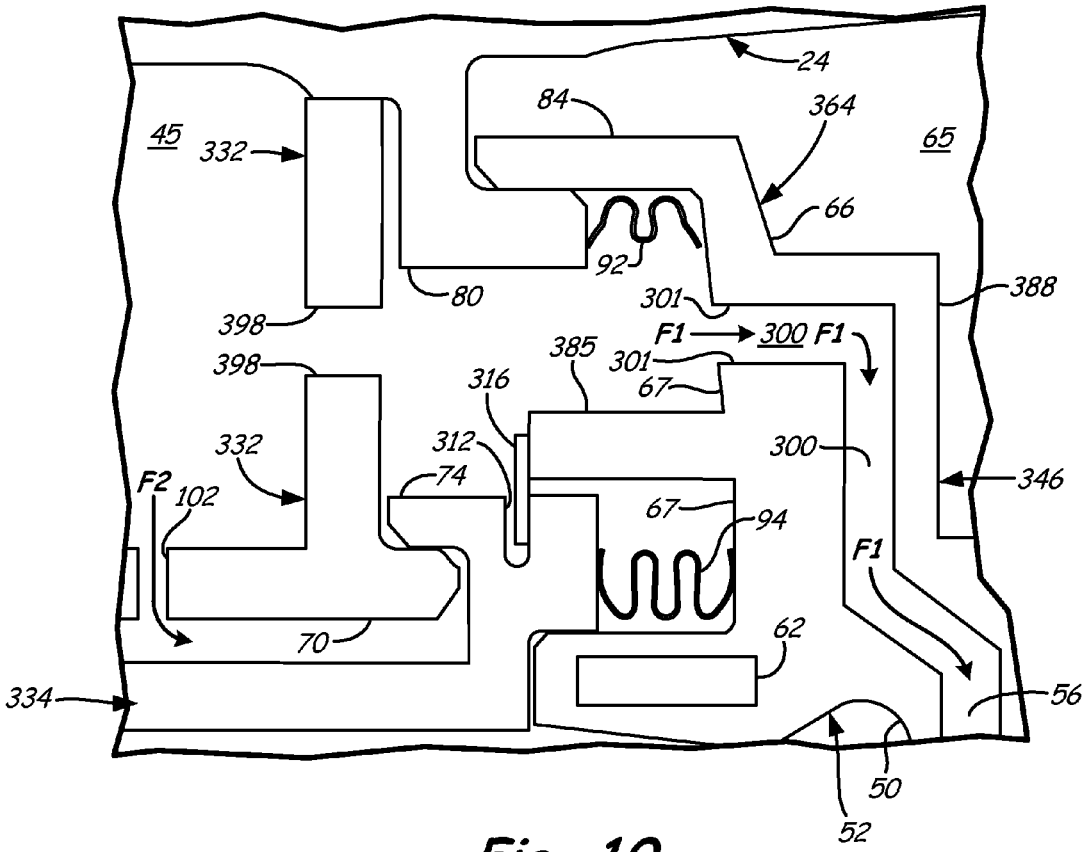
FIG. 10 is a sectional view of the embodiment of the multi-feed cooling system shown in FIG. 8.

FIG. 10 is a sectional view of the embodiment of the multi-feed cooling system shown in FIG. 8 taken along a plane through thicker portion 388 as shown in FIG. 9. FIG. 10 shows one of the multi-feed cooling passageways, first cooling flow passageway 300 connecting leading edge internal cooling channel 56 to first plenum 45. FIG. 10 shows that BOAS support 332 further includes first BOAS support opening 398. Vane mounting hook 364 further includes first cooling flow passageway 300 and first mounting hook opening 301. First cooling flow passageway 300 extends from first mounting hook opening 301, through thicker portion 388 of vane mounting hook 364 to leading edge internal cooling channel 56. First mounting hook opening 301 is disposed at vane mounting hook second side 67 between vane flange 385 and vane mounting flange 84.

In operation, first cooling air flow F1 flows from first plenum 45 through first BOAS support opening 398 into first cooling flow passageway 300 at first mounting hook opening 301. First cooling air flow F1 flows through first cooling flow passageway 300 within vane mounting hook 364 to leading edge internal cooling channel 56. Thicker portion 388 provides additional volume within vane mounting hook 364 to accommodate first cooling flow passageway 300.

Figure 11:
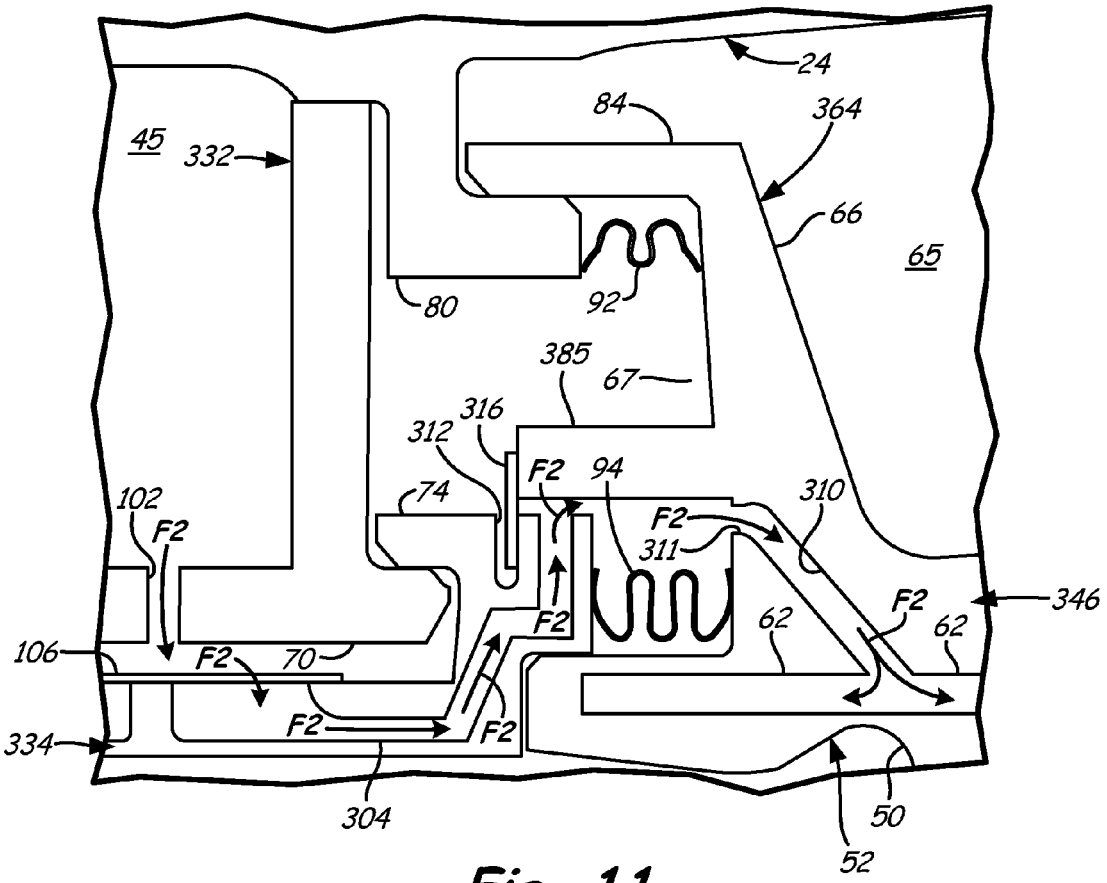
FIG. 11 is another sectional view of the embodiment of the multi-feed cooling system shown in FIG. 8.

FIG. 11 is another sectional view of the embodiment of the multi-feed cooling system shown in FIG. 8 taken along a plane not through thicker portion 388, as shown in FIG. 9. FIG. 11 shows second cooling flow passageway 310 connecting vane OD platform cooling channel 62 to first plenum 45. FIG. 11 shows that BOAS 334 further includes BOAS cooling channel 304. Vane mounting hook 364 further includes second cooling flow passageway 310 and second mounting hook opening 311. Second cooling flow passageway 310 extends from second mounting hook opening 311, through vane mounting hook 364, to vane OD platform cooling channel 62. Second mounting hook opening 311 is disposed at vane mounting hook second side 67 such that vane flange 385 is between first mounting hook opening 301, as shown in FIG. 10, and second mounting hook 311. BOAS cooling channel 304 is disposed within BOAS 334.

In operation, second cooling air flow F2 flows from first plenum 45, through second BOAS support opening 102, through BOAS impingement plate 106 and into BOAS cooling channel 304. Second cooling air flow F2 flows out of BOAS cooling channel 304 into a space radially inward from vane flange 385 between flap seal 316, and vane mounting hook 364. Second cooling air flow F2 then flows into second cooling flow passageway 310 at second mounting hook opening 311. Second cooling air flow F2 flows through second cooling flow passageway 310 within vane mounting hook 364 to vane OD platform cooling channel 62.

As with previous embodiments, separation of first cooling air flow F1 from second cooling air flow F2 is important to maintain the efficient distribution of cooling air to stator vane 346. Considering FIGS. 8, 9, 10, and 11 together, this separation is achieved within vane mounting hook 364 by virtue of separate passageways—first cooling flow passageway 300 and second cooling flow passageway 310. Separation between first mounting hook opening 301 and second mounting hook opening 311 is achieved in this embodiment by BOAS vertical feather seal 314, flap seal 316, vane flange feather seal 320, and vane flange 385. In operation, air pressure from first plenum 45, presses flap seal 316 against a side of BOAS flap seal channel 312 and against vane flange 385 to separate first cooling air flow F1 from second cooling air flow F2.

As with the previous embodiment, the embodiment shown in FIGS. 2, 8, 9, 10, and 11 provides multiple cooling feeds to portions of stator vane 346 to efficiently supply the cooling needs of stator vane 346. Cooling air supplied by three separate cooling flows to allow gas turbine engine 10 to expend less energy providing cooling air to stator vane 346. The embodiment also uses second cooling air flow F2 to cool vane OD platform 52 after it has cooled BOAS 334, thus cooling vane OD platform 52 without taking additional air from either first plenum 45 or second plenum 65 to further reducing the energy penalty on gas turbine engine 10 to cool stator vane 346.

Figure 12:
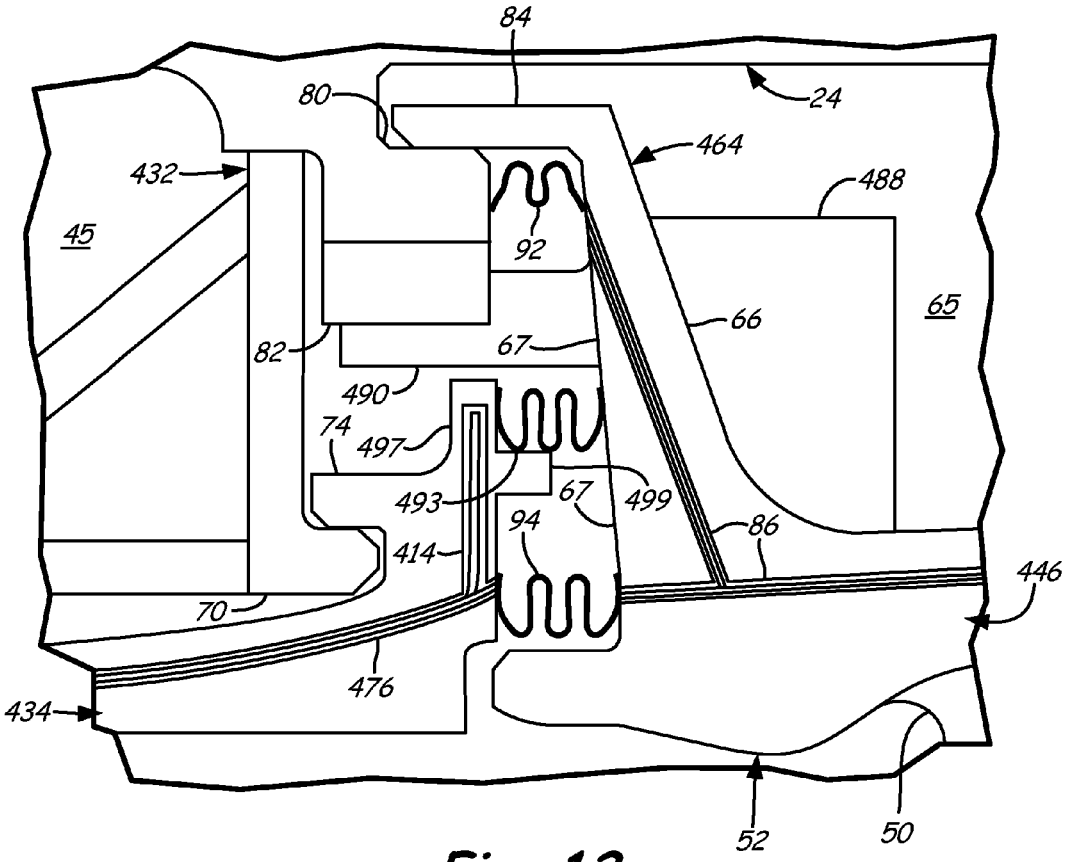
FIG. 12 is a further enlarged side view of a portion of the turbine portion of FIG. 2 illustrating details of a cooling system and stator vane embodying the present invention of a multi-feed cooling system.

FIG. 12 is a further enlarged side view of a portion of the turbine portion of FIG. 2 illustrating details of a cooling system and stator vane embodying the present invention of a multi-feed cooling system. The embodiment of FIG. 12 is identical to the embodiment of FIG. 8 described above, except that middle seal 493 replaces BOAS flap seal 312 and vane flange 385 to help maintain separation between first mounting hook opening 401, shown in FIG. 13, and second mounting hook opening 411 shown in FIG. 14. As shown in FIG. 12 and compared to the embodiment shown in FIG. 8, BOAS 434 includes BOAS mounting hook extension 497 and seal shelf 499, but does not include BOAS flap seal channel 312. BOAS mounting hook extension 497 is a radially extending flange extending from BOAS mounting hook 74 to provide a surface against which middle seal 493 can seal. Seal shelf 499 is an axial extending flange to provide support for middle seal 493. BOAS vertical feather seal 414 is similar to BOAS vertical feather seal 314, but it extends into BOAS mounting hook extension 497. BOAS main feather seal 476 is identical to BOAS main feather seal 376 shown in FIG. 8, but adjusted as necessary to accommodate a connection with BOAS vertical feather seal 414. Vane mounting hook 464 of stator vane 446 does not include vane flange 385. BOAS support 432 is identical to BOAS support 332, and first BOAS support opening 498 (shown in FIG. 13) is identical to first BOAS support 398, as described above in reference the embodiment shown in FIGS. 8, 9, 10, and 11.

As shown in FIG. 12, this embodiment of the multi-feed cooling system includes upper seal 92, lower seal 94, and middle seal 493. Upper seal 92, lower seal 94, and middle seal 493 as shown in FIG. 12 are annular type seals which may be formed sheet-stock based seals ("W" seals), but may also be, for example, C seals, crush seals, dog bone seals, brush seals, or rope seals. Middle seal 493 is adjacent BOAS mounting flange extension 497 to seal between BOAS 434 and vane mounting hook second side 67.

Figure 13:
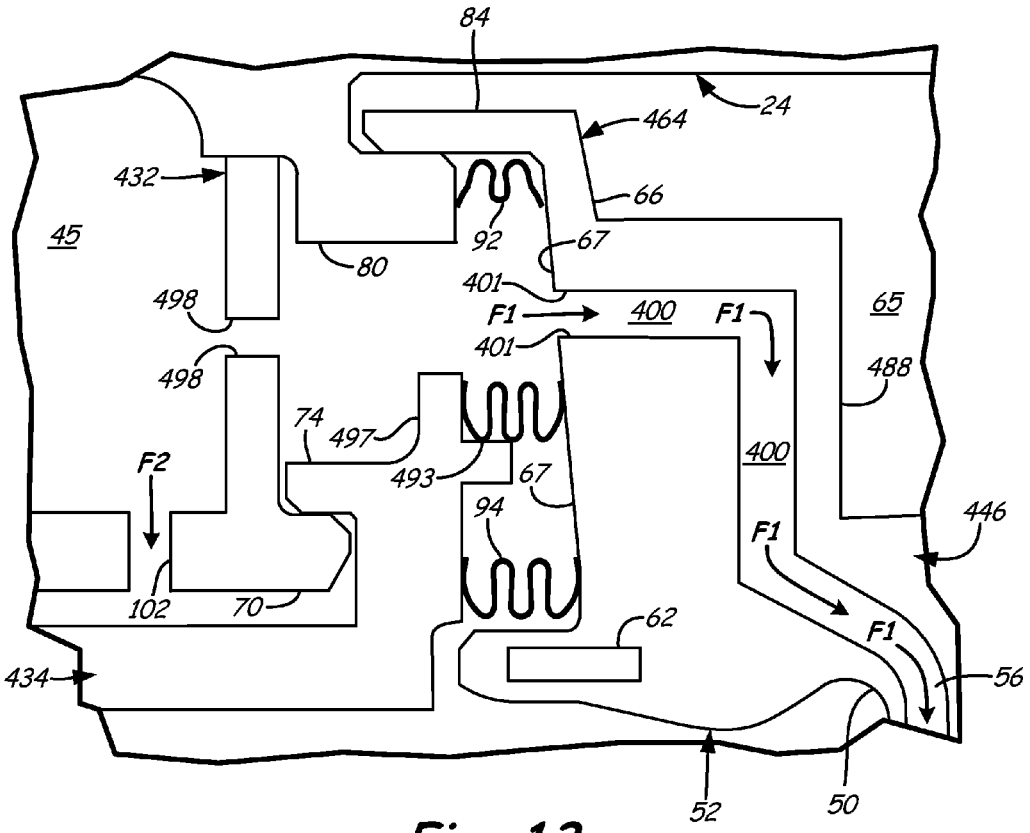
FIG. 13 is a sectional view of the embodiment of the multi-feed cooling system shown in FIG. 12.

FIG. 13 is a sectional view of the embodiment of the multi-feed cooling system shown in FIG. 12 taken along a plane through thicker portion 488 as shown in FIG. 9. FIG. 13 shows one of the multi-feed cooling passageways, first cooling flow passageway 400 connecting leading edge internal cooling channel 56 to first plenum 45. Vane mounting hook 464 further includes first cooling flow passageway 400 and first mounting hook opening 401. First cooling flow passageway 400 extends from first mounting hook opening 401, through thicker portion 488 of vane mounting hook 464 to leading edge internal cooling channel 56. Thicker portion 488 is identical to thicker portion 388 as described above in reference the embodiment shown in FIGS. 8, 9, 10, and 11, with first cooling flow passageway 400 replacing first cooling flow passageway 300. First mounting hook opening 401 is disposed at vane mounting hook second side 67 radially outward from middle seal 493. In operation, first cooling air flow F1 flows from first plenum 45 through first BOAS support opening 498 into first cooling flow passageway 400 at first mounting hook opening 401. First cooling air flow F1 flows through first cooling flow passageway 400 within vane mounting hook 464 to leading edge internal cooling channel 56.

Figure 14:
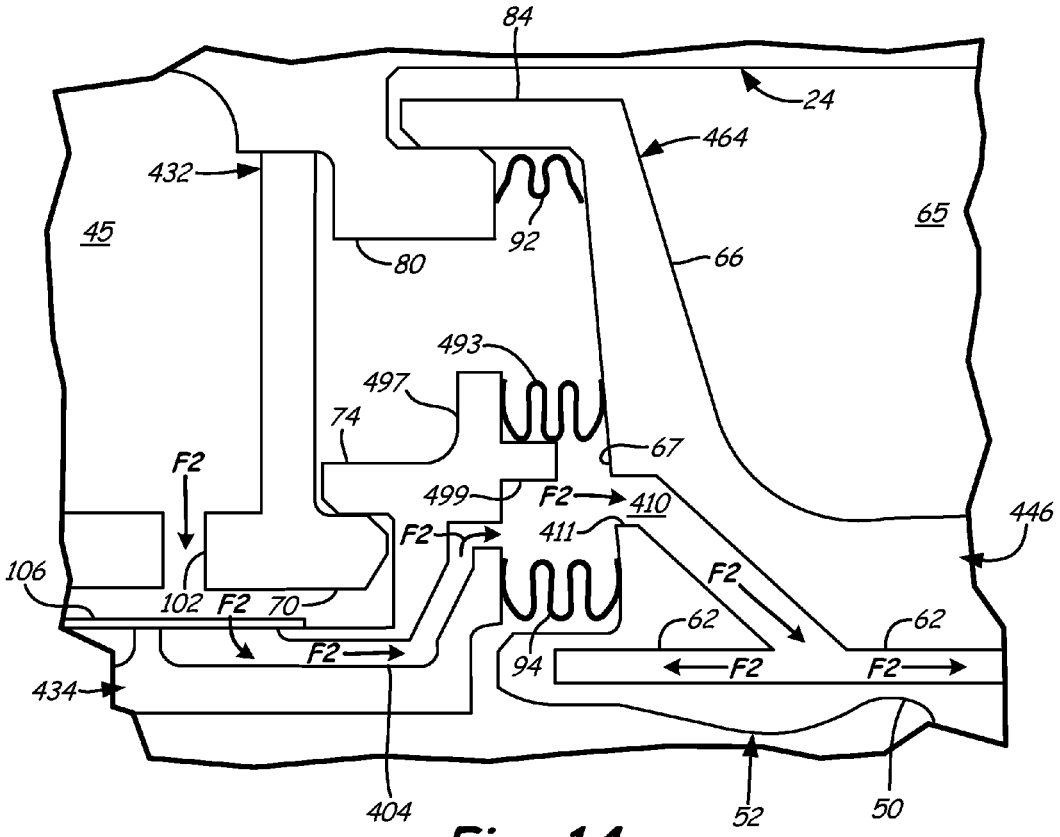
FIG. 14 is another sectional view of the embodiment of the multi-feed cooling system shown in FIG. 12.

FIG. 14 is another sectional view of the embodiment of the multi-feed cooling system shown in FIG. 12 taken along a plane not through thicker portion 488, as shown in FIG. 9. FIG. 14 shows second cooling flow passageway 410 connecting vane OD platform cooling channel 62 to first plenum 45. FIG. 14 shows that BOAS 434 further includes BOAS cooling channel 404. Vane mounting hook 464 further includes second cooling flow passageway 410 and second mounting hook opening 411. Second cooling flow passageway 410 extends from second mounting hook opening 411, through vane mounting hook 464, to vane OD platform cooling channel 62. Second mounting hook opening 411 is disposed at vane mounting hook second side 67 radially inward from middle seal 493 such that middle seal 493 is between first mounting hook opening 401, as shown in FIG. 13, and second mounting hook opening 411. BOAS cooling channel 404 is disposed within BOAS 434.

In operation, second cooling air flow F2 flows from first plenum 45, through second BOAS support opening 102, through BOAS impingement plate 106 and into BOAS cooling channel 404. Second cooling air flow F2 flows out of BOAS cooling channel 404 into a space between middle seal 493 and lower seal 94 and between BOAS 434 and vane mounting hook 464. Second cooling air flow F2 then flows into second cooling flow passageway 410 at second mounting hook opening 411. Second cooling air flow F2 flows through second cooling flow passageway 410 within vane mounting hook 464 to vane OD platform cooling channel 62.

As with previous embodiments, in the embodiment shown in FIGS. 2, 12, 13, and 14, separation of first cooling air flow F1 from second cooling air flow F2 is important to maintain the efficient distribution of cooling air to stator vane 446. This separation is achieved within vane mounting hook 464 by virtue of separate passageways—first cooling flow passageway 400 and second cooling flow passageway 410. Separation between first mounting hook opening 401 and second mounting hook opening 411 is achieved in this embodiment by BOAS vertical feather seal 414 and by middle seal 493 sealing against BOAS mounting hook extension 497.

As with the previous embodiment, this embodiment provides multiple cooling feeds to portions of stator vane 446 to efficiently supply the cooling needs of stator vane 446. Cooling air is supplied by three separate cooling flows to allow gas turbine engine 10 to expend less energy providing cooling air to stator vane 446. The embodiment also uses second cooling air flow F2 to cool vane OD platform 52 after it has cooled BOAS 434, thus cooling vane OD platform 52 without taking additional air from either first plenum 45 or second plenum 65 to further reducing the energy penalty on gas turbine engine 10 to cool stator vane 446.

In the embodiments described above, BOAS supports, BOAS, and stator vanes are each made of individual segments joined together to form annular structures centered on engine centerline $C_L$. However, it is understood that the present invention encompasses embodiments employing unitary, non-segmented BOAS supports, BOAS, or stator vanes.

Also, in the embodiments described above, the second cooling flow passageway supplies cooling air from an adjacent BOAS that had been used to cool the BOAS. However, it is understood that the present invention encompasses embodiments employing other adjacent components where a cooling channel in the adjacent component supplies a cooling air flow to the second cooling flow passageway within a vane mounting hook.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A cooling system for a gas turbine engine can include a first plenum bounded in part by a first portion of an engine casing and a mounting hook; the first portion of the engine casing disposed radially outward from a rotor stage adjacent to a stator vane; the mounting hook connecting the stator vane to the engine casing between the first portion of the engine casing and a second portion of the engine casing disposed radially outward from the stator vane; a first cooling flow passageway in fluid communication with the first plenum and with a first airfoil cooling channel within an airfoil of the stator vane; the first airfoil cooling channel for cooling a leading edge of the airfoil; the first cooling flow passageway disposed within the mounting hook; and a second cooling flow passageway in fluid communication with the first plenum and with a platform cooling channel within an outer diameter platform of the stator vane; the second cooling flow passageway disposed within the mounting hook; wherein the first cooling flow passageway and the second cooling flow passageway are not in fluid communication with each other.

The component of the preceding paragraph can optionally include, additionally and/or alternatively, any one or more of the following features, configurations and/or additional components:

the second cooling flow passageway is in fluid communication with the first plenum by way of fluid communication with a cooling channel within a BOAS of the rotor stage;

fluid communication between the first plenum and the first cooling flow passageway is isolated from fluid communication between the cooling channel within the BOAS and the second cooling flow passageway by a seal; the seal disposed between the mounting hook and the BOAS;

the seal is at least one of a W seal, a dog bone seal, a brush seal, a rope seal, a C seal, a crush seal, a flap seal, and a feather seal;

the first cooling flow passageway is within an alignment feature of the mounting hook;

the alignment feature extends through an opening in a BOAS support structure of the rotor stage;

the first cooling flow passageway is in fluid communication with the first plenum by way of a transfer tube between an opening in the BOAS support structure and the first cooling flow passageway;

a second plenum bounded in part by the second portion of the engine casing and the mounting hook; a third cooling flow passageway in fluid communication with the second plenum and with a second airfoil cooling channel within an airfoil of the stator vane; and the first plenum and the second plenum each supply cooling air; and the first plenum supplies cooling air at a higher air pressure than the second plenum.

A method of cooling a portion of a gas turbine engine can include providing a first source of cooling air to a first plenum; flowing a first cooling air flow from the first plenum to a first airfoil cooling channel within an airfoil of a stator vane; the first airfoil cooling channel for cooling a leading edge of the airfoil; the first cooling air flow passing through a first cooling flow passageway disposed within a mounting hook of the stator vane; and flowing a second cooling air flow from the first plenum to a cooling channel within an outer diameter vane platform, the second cooling air flow passing through a second cooling flow passageway disposed within the mounting hook of the stator vane.

The method of the preceding paragraph can optionally include, additionally and/or alternatively, any one or more of the following features, configurations and/or additional components:

the first cooling flow passageway and the second cooling flow passageway are not in fluid communication with each other;

flowing a second cooling air flow from the first plenum to a cooling channel within an outer diameter vane platform includes flowing the second cooling air flow through a cooling channel within a BOAS of a rotor stage adjacent to the stator vane before flowing the second cooling air flow through the second cooling flow passageway;

isolating the first cooling air flow between the first plenum and the first cooling flow passageway from the second cooling air flow between the cooling channel within the BOAS and the second cooling flow passageway;

the first cooling flow passageway is disposed within an alignment feature of the mounting hook;

flowing the first cooling air flow from the first plenum to a first airfoil cooling channel within the airfoil includes flowing the first cooling air flow through a transfer tube between the first cooling flow passageway and an opening in a BOAS support structure of a rotor stage adjacent to the stator vane;

providing a second source of cooling air to a second plenum; flowing a third cooling air flow from the second plenum to a second airfoil cooling channel within the airfoil, the third cooling air flow passing through a first cooling flow passageway disposed within the outer diameter platform of the stator vane; and the cooling air provided to the first plenum is at a higher air pressure than the cooling air provided to the second plenum.

A stator vane for a gas turbine engine can include a predominantly arcuate inner diameter platform; an airfoil extending from a radially outer surface of the inner diameter platform, the airfoil including a first airfoil cooling channel for cooling a leading edge of the airfoil; and a predominantly arcuate outer diameter platform connected to the airfoil opposite the inner diameter platform; the airfoil connected to a radially inner surface of the outer diameter platform; the outer diameter platform including a platform cooling channel within the outer diameter platform; and a mounting hook extending radially outward from the outer diameter platform, the mounting hook including: a first side facing the space radially outward from a radially outer surface of the outer diameter platform; a second side facing a direction opposite that of the first side; a first cooling flow passageway disposed within the mounting hook and extending from a first opening in the second side to the first airfoil cooling channel; and a second cooling flow passageway disposed within the mounting hook and extending from a second opening in the second side to the platform cooling channel; wherein the first cooling flow passageway and the second cooling flow passageway do not intersect.

The component of the preceding paragraph can optionally include, additionally and/or alternatively, any one or more of the following features, configurations and/or additional components:

the second side of the mounting hook further comprises an alignment feature and the first opening is in the alignment feature;

the first opening is shaped for connecting the first cooling flow passageway to a transfer tube;

the mounting hook further includes a flange projecting from the second side and running in a circumferential direction, the flange running between the first opening and the second opening;

a portion of the mounting hook containing a portion of the first cooling flow passageway is thicker than a remaining portion of the mounting hook; and the stator vane can further include a second airfoil cooling channel within the airfoil, the second airfoil cooling channel farther than the first airfoil cooling channel from the leading edge of the airfoil; and a third cooling flow passageway disposed within the outer diameter platform and extending from the space radially outward from the radially outer surface of the outer diameter platform to the second airfoil cooling channel.

The invention claimed is:

1. A cooling system for a gas turbine engine, the cooling system comprising:

a first plenum bounded in part by a first portion of an engine casing and a mounting hook; the first portion of the engine casing disposed radially outward from a rotor stage adjacent to a stator vane; the mounting hook connecting the stator vane to the engine casing between the first portion of the engine casing and a second portion of the engine casing disposed radially outward from the stator vane;

a first cooling flow passageway in fluid communication with the first plenum and with a first airfoil cooling channel within an airfoil of the stator vane; the first airfoil cooling channel for cooling a leading edge of the airfoil; the first cooling flow passageway disposed within the mounting hook; and a second cooling flow passageway in fluid communication with the first plenum and with a platform cooling channel within an outer diameter platform of the stator vane; the second cooling flow passageway disposed within the mounting hook;

wherein the first cooling flow passageway and the second cooling flow passageway are not in fluid communication with each other.

2. The system of claim 1, wherein the second cooling flow passageway is in fluid communication with the first plenum by way of fluid communication with a cooling channel within a BOAS of the rotor stage.

3. The system of claim 2, wherein fluid communication between the first plenum and the first cooling flow passageway is isolated from fluid communication between the cooling channel within the BOAS and the second cooling flow passageway by a seal; the seal disposed between the mounting hook and the BOAS.

4. The system of claim 3, wherein the seal is at least one of a W seal, a dog bone seal, a brush seal, a rope seal, a C seal, a crush seal, a flap seal, and a feather seal.

5. The system of claim 1, wherein the first cooling flow passageway is within an alignment feature of the mounting hook.

6. The system of claim 5, wherein the alignment feature extends through an opening in a BOAS support structure of the rotor stage.

7. The system of claim 5, wherein the first cooling flow passageway is in fluid communication with the first plenum by way of a transfer tube between an opening in the BOAS support structure and the first cooling flow passageway.

8. The system of claim 1, wherein cooling system further comprises:

a second plenum bounded in part by the second portion of the engine casing and the mounting hook;

a third cooling flow passageway in fluid communication with the second plenum and with a second airfoil cooling channel within an airfoil of the stator vane.

9. The system of claim 8, wherein the first plenum and the second plenum each supply cooling air; and the first plenum supplies cooling air at a higher air pressure than the second plenum.

10. A method of cooling a portion of a gas turbine engine comprises:

providing a first source of cooling air to a first plenum;

flowing a first cooling air flow from the first plenum to a first airfoil cooling channel within an airfoil of a stator vane; the first airfoil cooling channel for cooling a leading edge of the airfoil; the first cooling air flow passing through a first cooling flow passageway disposed within a mounting hook of the stator vane; and flowing a second cooling air flow from the first plenum to a cooling channel within an outer diameter vane platform, the second cooling air flow passing through a second cooling flow passageway disposed within the mounting hook of the stator vane.

11. The method of claim 10, wherein the first cooling flow passageway and the second cooling flow passageway are not in fluid communication with each other.

12. The method of claim 10, wherein flowing a second cooling air flow from the first plenum to a cooling channel within an outer diameter vane platform includes flowing the second cooling air flow through a cooling channel within a BOAS of a rotor stage adjacent to the stator vane before flowing the second cooling air flow through the second cooling flow passageway.

13. The method of claim 12, further comprising isolating the first cooling air flow between the first plenum and the first cooling flow passageway from the second cooling air flow between the cooling channel within the BOAS and the second cooling flow passageway.

14. The method of claim 10, wherein the first cooling flow passageway is disposed within an alignment feature of the mounting hook.

15. The method of claim 14, wherein flowing the first cooling air flow from the first plenum to a first airfoil cooling channel within the airfoil includes flowing the first cooling air flow through a transfer tube between the first cooling flow passageway and an opening in a BOAS support structure of a rotor stage adjacent to the stator vane.

16. The method of claim 10, further comprising:

providing a second source of cooling air to a second plenum;

flowing a third cooling air flow from the second plenum to a second airfoil cooling channel within the airfoil, the third cooling air flow passing through a first cooling flow passageway disposed within the outer diameter platform of the stator vane.

17. The method of claim 16, wherein the cooling air provided to the first plenum is at a higher air pressure than the cooling air provided to the second plenum.

18. A stator vane for a gas turbine engine, the stator vane comprising:

a predominantly arcuate inner diameter platform;

an airfoil extending from a radially outer surface of the inner diameter platform, the airfoil including a first airfoil cooling channel for cooling a leading edge of the airfoil; and a predominantly arcuate outer diameter platform connected to the airfoil opposite the inner diameter platform; the airfoil connected to a radially inner surface of the outer diameter platform; the outer diameter platform including:

a platform cooling channel within the outer diameter platform; and a mounting hook extending radially outward from the outer diameter platform, the mounting hook including:

a first side facing the space radially outward from a radially outer surface of the outer diameter platform;

a second side facing a direction opposite that of the first side;

a first cooling flow passageway disposed within the mounting hook and extending from a first opening in the second side to the first airfoil cooling channel; and a second cooling flow passageway disposed within the mounting hook and extending from a second opening in the second side to the platform cooling channel;

wherein the first cooling flow passageway and the second cooling flow passageway do not intersect.

19. The stator vane of claim 18, wherein the second side of the mounting hook further comprises an alignment feature and the first opening is in the alignment feature.

20. The stator vane of claim 19, wherein the first opening is shaped for connecting the first cooling flow passageway to a transfer tube.

21. The stator vane of claim 18, wherein the mounting hook further includes a flange projecting from the second side and running in a circumferential direction, the flange running between the first opening and the second opening.

22. The stator vane of claim 18, wherein a portion of the mounting hook containing a portion of the first cooling flow passageway is thicker than a remaining portion of the mounting hook.

23. The stator vane of claim 18, further comprising:

a second airfoil cooling channel within the airfoil, the second airfoil cooling channel farther than the first airfoil cooling channel from the leading edge of the airfoil; and a third cooling flow passageway disposed within the outer diameter platform and extending from the space radially outward from the radially outer surface of the outer diameter platform to the second airfoil cooling channel.

* * * * *